US005680821A

United States Patent [19]

Wright et al.

[11] Patent Number: 5,680,821

[45] Date of Patent: Oct. 28, 1997

[54] SOLID WASTE HANDLING AND CONVEYING APPARATUS

[75] Inventors: Frank Wright, Rowlett; Matthew Fleeger, Dallas, both of Tex.

[73] Assignee: Advanced Envirotech Systems, Inc., Dallas, Tex.

[21] Appl. No.: 192,106

[22] Filed: Feb. 4, 1994

[51] Int. Cl.[6] ..... F23G 5/00

[52] U.S. Cl. ..... 110/257; 110/110; 110/258

[58] Field of Search ..... 110/228, 110, 110/255, 257, 258; 588/249

[56] References Cited

U.S. PATENT DOCUMENTS

| | | | |
|---|---|---|---|
| 4,430,949 | 2/1984 | Ekenberg | 110/110 X |
| 4,667,606 | 5/1987 | Svard | 110/110 |
| 5,178,077 | 1/1993 | Norris et al. | 110/110 X |
| 5,277,136 | 1/1994 | Davis | 110/110 X |

FOREIGN PATENT DOCUMENTS

| | | | |
|---|---|---|---|
| 0084921 | 5/1982 | Japan | 110/110 |

*Primary Examiner*—Henry A. Bennett
*Assistant Examiner*—Susanne C. Tinker
*Attorney, Agent, or Firm*—Fulbright & Jaworski L.L.P.

[57] ABSTRACT

A method and apparatus for safely conveying hazardous solid waste material to a waste processing system; for enhancing its subsequent combustion, in the case of an incinerator; and for reducing the size and duration of a moisture plume created by water vapor in the gases exiting such combustion process. The waste may be inside boxes, bags, or other containers, or may be in loose bulk form. The waste is dropped into a hopper. The hopper lid is of a design to offer safety from personal exposure to the waste and from any size reduction equipment, such as a shredder, and/or conveying machinery that might be at the bottom of the combustion chamber in the case of an incinerator. An air draft is hopper. The waste is allowed to fall onto a conveying mechanism which then delivers the waste for processing, such as to a maintained through the hopper, any size reduction equipment, the conveying machinery, and into a combustion process, if present, which enhances both the safety and operation of the system, and the completeness of combustion of the waste, in the case of an incinerator. The moisture plume resulting from the combustion is shaped and given a spin by a specially shaped exhaust section which allows the water vapor in the plume to disperse, and the plume to disappear more rapidly.

7 Claims, 1 Drawing Sheet

SOLID WASTE HANDLING AND CONVEYING APPARATUS

FIELD OF INVENTION

This invention relates to the handling of solid waste and to the products of combustion, in the case of a subsequent combustion process. More particularly, this invention relates to a method and apparatus for feeding or conveying solid waste in a safe manner, while enhancing the operation of the process, and for minimizing the size and persistence of the water vapor plume resulting from the subsequent combustion of the waste.

BACKGROUND ART

Due to a growing awareness of environmental responsibilities, particularly in the area of the handling and disposal of solid waste there is a realization that the amount of solid waste generated from a wide variety of industry, public and private facilities, and households, must be minimized. The aesthetic quality of the waste handling process is also important in community acceptance of any such process. "Storing" solid waste in landfills becomes less attractive environmentally and financially as time passes. Existing ways of handling solid waste, as part of a waste minimization or waste destruction process, can present a hazard to the personnel involved in the operation.

If the waste to be processed is hazardous or infectious, any personnel, material, or equipment that comes into contact with, or within close proximity to, the waste can also become contaminated due to the hazardous or infectious nature of the waste. For example, in the case of waste from a hospital, the waste may carry a variety of micro-organisms which could cause diseases such as Hepatitis B or AIDS (Acquired Immune Disorder Syndrome), the waste may carry chemotherapy chemicals which can cause humane cell damage, and the waste may carry carcinogenic compounds which can cause cancer. If these materials were to get on areas of the processing equipment which may come into contact with personnel, the hazards are obvious. Not quite so obvious is the fact that personnel may become contaminated without direct contact. For example, if personnel are in close proximity to the exposed waste or to contaminated equipment, a breeze or air draft may cause personnel to be exposed to infectious air-borne micro-organisms from the infectious waste. It is important that hazardous waste be "contained" as effective as possible. Some waste loading systems use a cart that is tipped, allowing the waste to slide across an apron, that is part of the cart tipping mechanism, and into the waste processing equipment. This method is dangerous to personnel because they are now exposed to the waste on the apron, and are frequently required to wipe it off, thereby risking even more intimate contact with the waste.

If the waste is to be processed thermally, such as by incineration, the waste may or may not be shredded before being conveyed into the combustion chamber. Some methods deliver the waste using a hydraulic ram, a screw auger, or a conveyor belt or some type, into the combustion chamber where the extreme temperature consumes the waste.

In most cases, the waste does not consist of a single type of material, such as paper; but rather consists of a variety of materials such as paper, fabric plastic film, cardboard, food waste, liquid solvents, metal, and glass. With the exception of the metal and glass which will not burn, the other materials are organic and would be consumed in an incinerator. The food waste, liquid, and solvents could be stick and viscous at ordinary room temperatures. Some of these materials, such as the fabric and plastic film could soften and become sticky or viscous as they become hot.

As the material is being conveyed it may stick, and if hot may even fuse, to the ram, auger, or conveyor belt. Over time the waste may build up in thickness on the conveyance, to the degree that waste becomes stuck to the ram face, thereby-blocking the entrance to the ram chamber; or in the case of the screw auger, waste builds up between the auger flights, choking the flits closed; or in the case or the conveyor sticking to the conveyor so that rather than falling off at the hot end (combustion chamber end) of the conveyor the waste is carried back around. In each of the above scenarios, the inability to effectively keep the waste from sticking to the conveyance, renders the conveyance inefficient in some cases, and unusable in more severe cases.

If a combustion process is employed in the processing of the waste, it is important to have excess air available in the combustion chamber, that is, more oxygen than that needed for the complete combustion of the waste. More over, if the waste is dispersed by some means as it enters such a combustion process, the combustion will proceed more rapidly because of the more intimate mixing of the waste and the heated air in the combustion chamber.

The chemical by-products of a combustion process are water vapor and other gases. These combustion gases may be cooled by spraying water into the gases. Water has a high latent heat of vaporization. As the water spray evaporates, it absorbs heat energy from the hot gases, effectively cooling the gases. When such gases exist a combustion process, a water vapor plume may be visible at the exhaust stack, depending upon the amount of water vapor in the gases, and upon atmospheric temperature and humidity. Minimizing or eliminating this visible plume may be important for community acceptance of the process, because the plume may incorrectly be though to be smoke emitting from the process.

SUMMARY OF THE INVENTION

It is the object of this invention to provide a method and apparatus to safely and effectively convey a variety of waste materials as part of the overall operation of a waste processing system, and to minimize or eliminate the visible products of combustion, if combustion is a part of the waste processing. Other objects and advantages of the invention will be apparent from the description above, the description that follows, and from the claims below.

DETAILED DESCRIPTION

Figure 1:
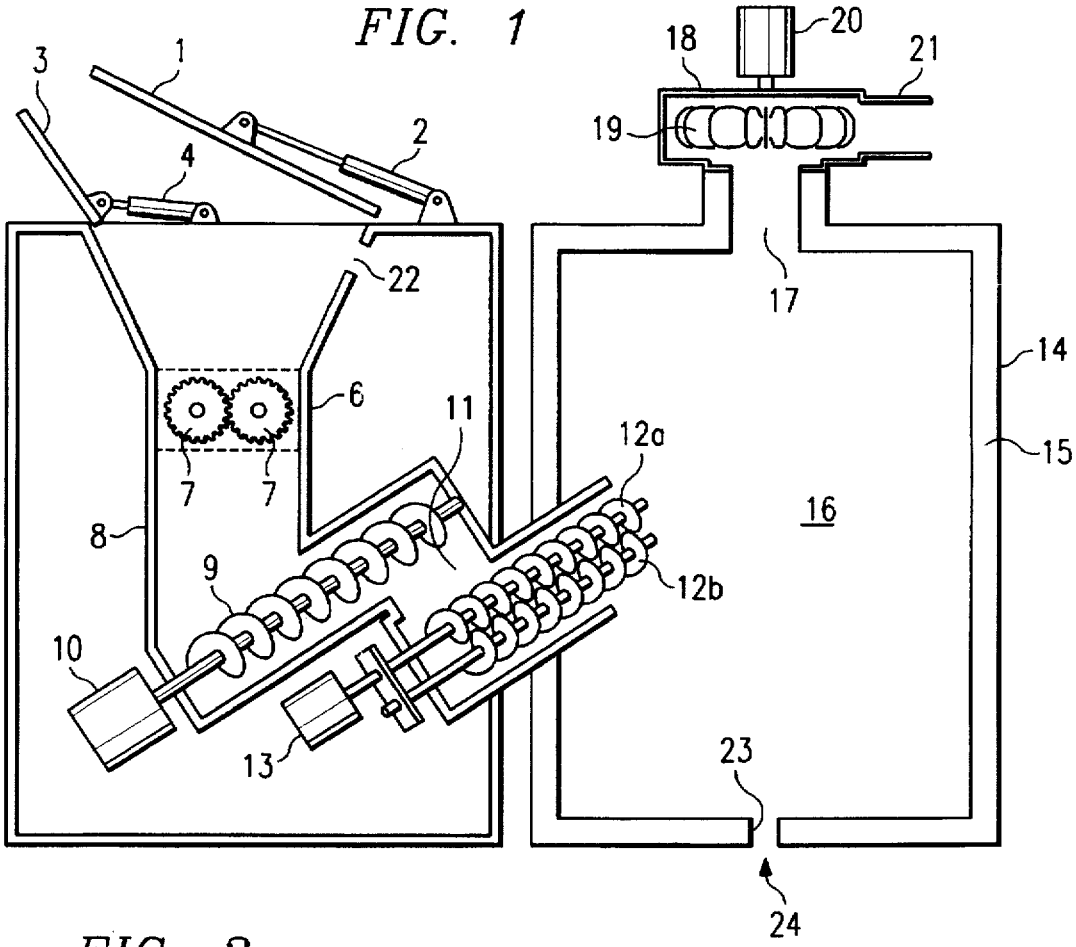
FIG. 1 illustrates a preferred embodiment for the handling of waste materials of the present invention.

In FIG. 1 the waste is dropped into a hopper above a shredder. A lid is provided for isolating the hopper and the shredder from personnel. This serves several purposes. If the hopper were not covered during the operation of the shredder, pieces of metal or glass in the waste could be ejected back out of the hopper by the rotating blades of the shredder, possibly injuring nearby personnel or equipment.

Further, dangerous micro-organisms, chemicals, and compounds discussed above are contained in the hopper, protecting personnel from exposure. The shredded material is allowed to fall onto a screw conveyor (auger), although a conveyor belt could also be used in the present invention. The auger carries the shredded waste toward and into the combustion chamber of the incinerator. The linear (axial) velocity component of the auger, created by the speed of revolution of the auger, or by the linear velocity of a belt conveyor, can be used to provide the waste with a velocity that carries it air-borne into the combustion chamber, thereby increasing the speed of its consumption in the incinerator. Indeed, the goal would be for the organic waste to have a trajectory that would allow it to be completely consumed before it could land on the hearth of the combustion chamber. In addition, air is induced to flow through the cavity containing the auger or belt conveyor to cool the belt conveyor, and to cool the hot auger tip. This cooling air can maintain the conveyance at a temperature below the softening and/or melting point of the solid organic materials, such as fabric and plastic, in the waste, thereby preventing said materials from sticking or fusing to the conveyance. In addition to cooling air, air jets, air knives, or other air operated means can be used to mechanically assist in loosening waste from the conveyance at the entrance to the combustion chamber; and also in propelling it into the combustion chamber, giving the waste an advantageous air-borne trajectory to aid in its combustion.

In FIG. 1, a primary hopper lid 1 is equipped with hydraulic actuators 2 that open the lid to allow for waste to enter the hopper 5, and close the lid to "contain" and seal the waste safely inside. Secondary hopper lid 3 is equipped with hydraulic actuators 4 which likewise open and close it. When waste is to be put into hopper 5, primary hopper lid i would first be raised to the open position. Next, secondary hopper lid 3 would be raised to its open position. Secondary hopper lid 3 acts as a chute or apron upon which the waste material may slide into the hopper 5. In operation, waste could contaminate lid 3 with micro-organisms, or hazardous chemicals or compounds. After the loading of hopper 5 is complete, secondary lid 3 will be lowered by hydraulic actuators 4; then primary lid 1 will be lowered by hydraulic actuators 2 until it closed and sealed hopper 5, the purpose of which is to isolate any contaminated surfaces of hopper lid 1 from personnel and from contaminating other surfaces of the equipment. Further, fan 18 induces a flow of air 21 from the system that creates and maintains a slight negative atmospheric pressure on the system. This negative pressure allows air to enter through port 22 in hopper 5 (or at any other location in the feed system shell). This flow of air travels through the feed system, providing a cooling effect, and eventually enters the combustion chamber 16. After the waste enters hopper 5, it falls into shredder 6, comprised of two sets of counter-rotating blades 7. The shredded waste falls through hopper 8 and onto a primary auger 9. Motor 10 may be a fixed speed or variable speed and either electric or hydraulic powered. Auger 9 is revolved by motor 10, said action conveying the shredded waste onto auger 12. Likewise, metro 13 may be a fixed speed or variable speed and either electric or hydraulic powered, and may power several augers simultaneously by employing appropriate gears, drive belts, etc. Likewise, augers **12*a* and 12*b* are revolved by motor 13, in the manner described above. Said action conveying the shredded waste into combustion chamber 16. Augers 12*a* and 12*b* are installed in cantilevered fashion with a distal end projecting through an opening in shell 14, and thermal insulation 15 of combustion chamber 16. Augers 12*a* and 12*b* revolve in opposite directions to each other and their pitch is such as so to allow the revolving flights of one auger to clean material from the revolving flights of the companion auger. Heated air 24 enters combustion chamber 16 through port 23, and is drawn out through port 17 by the action of the induced draft fan 18, having rotating impeller 19 powered by motor 20. The air exits induced draft fan 18 through port 21** to the atmosphere.

Figure 2:
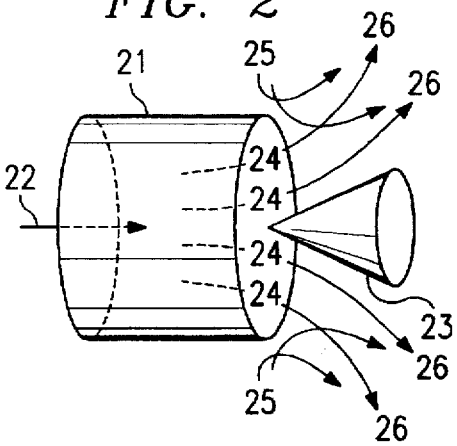
FIG. 2 illustrates a preferred embodiment for shaping a water vapor plume to minimize or eliminate it under the present invention.
Figure 3:
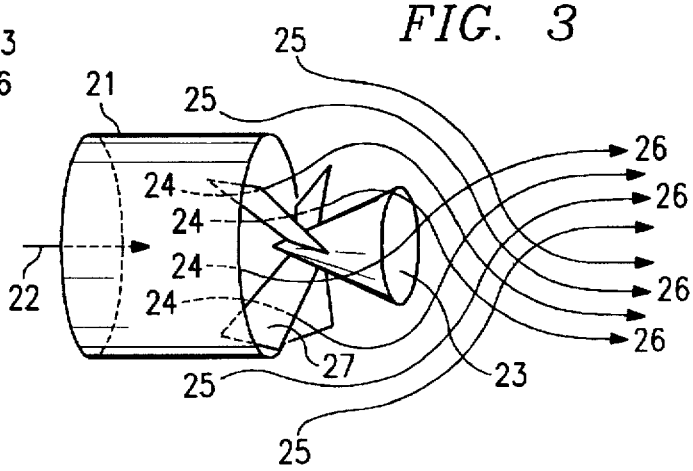
FIG. 3 illustrates a preferred embodiment for spinning a water vapor plume to minimize or eliminate it under the present invention.

In FIG. 2, exhaust gases 22 pass through exhaust port or stack 21. Flow diverting vane 23 causes exhaust gases 22 to be split into exhaust gas components 24. Exhaust gas components 24 exit exhaust port or stack 21 and mix intimately with atmospheric gases 25 to form blended gases 26. Blended gases 26 now have reduced temperature and humidity compared to the unmixed exhaust gases 22.

What is claimed is:

1. An apparatus for conveying waste material into a combustion chamber comprising:

a device having a longitudinal shape for receiving said waste material therealong, said device having a first distal end, said longitudinal device moving said waste material towards said first distal end, said moving material falling from said device proximate to said first distal end; and a pair of augers, each auger of said pair of augers having a proximal end disposed proximate to and below said first distal end of said longitudinal device for receiving said falling waste material and a second distal end disposed proximate to an input aperture of said combustion chamber, said pair of augers having flights on a substantially common and uniform pitch; and wherein said pair of augers are parallel to one another and wherein the combined rotation of said auger pair move said waste material into said combustion chamber and wherein the flights of said auger pair intermesh such that the combined rotation thereof deters the waste material from accumulating thereon; and wherein said auger pair rotates at sufficient speed to discharge said waste material into said combustion chamber along a non-vertical trajectory.

2. The apparatus set forth in claim 1, wherein each auger of said pair of augers is cantilevered from said proximal end thereof.

3. An apparatus for conveying waste material into an aperture in a combustion chamber comprising:

a first conduit having a first end and a second end, said first end having a first aperture for receiving said waste material and said second end having a second aperture;

a first auger disposed in said first conduit for moving said waste material within said first conduit;

a second conduit having a first end and a second end, said first end having a first aperture communicating with said second aperture of said first conduit and said second end having a second aperture communicating with said aperture in said combustion chamber, said second conduit also disposed to be cooled by forced air blown therethrough;

a second auger disposed in said second conduit for moving said waste material within said second conduit, said second auger having a flight of substantially uniform pitch; and a third auger disposed in said second conduit parallel to said second auger for moving said waste material within said second conduit, said third auger having a flight of substantially uniform pitch common to the flight of said second auger and wherein said flight of said third auger and said flight of said second auger intermesh such that the combined rotation thereof deters said waste material from accumulating thereon.

4. The apparatus as set forth in claim 3 wherein said second auger and said third auger rotate in opposite directions.

5. The apparatus as set forth in claim 3 wherein said second auger and said third auger discharge said waste material into said combustion chamber along a non-vertical trajectory.

6. The apparatus as set forth in claim 3 wherein said combustion chamber induces an air draft through said second conduit, said air draft operable to cool said second conduit and said second and third augers.

7. The apparatus set forth in claim 3, wherein at least one of said second auger and said third auger is cantilevered from said proximal end thereof.

* * * * *